United States Patent [19]

Sliger et al.

[11] Patent Number: 5,009,264

[45] Date of Patent: Apr. 23, 1991

[54] WELL PRODUCTION APPARATUS INCLUDING PUMP MEANS AND THERMAL ABSORPTION MEANS

[75] Inventors: Kris M. Sliger, Denver, Colo.; Randolph C. Moeller, Casper, Wyo.; Scott E. Williamson, Castle Rock, Colo.

[73] Assignee: Baker Hughes Incorporated, Houston, Tex.

[21] Appl. No.: 527,748

[22] Filed: May 23, 1990

[51] Int. Cl.[5] ..... E21B 33/128

[52] U.S. Cl. ..... 166/106; 166/62; 166/125

[58] Field of Search ..... 166/369, 373, 386, 387, 166/106, 125, 242, 62, 240

[56] References Cited

U.S. PATENT DOCUMENTS 4,008,759 2/1977 Blackwell ..... 166/120
4,601,333 7/1986 Evans ..... 166/115
4,697,640 10/1987 Szarka ..... 166/120

*Primary Examiner*—William P. Neuder
*Attorney, Agent, or Firm*—Rosenblatt & Associates

[57] ABSTRACT

A well production apparatus includes a tubular production conduit which extends from the top of the well to a production zone interior of casing. An electric submersible pump has a production fluid flow passageway which communicates between the exterior of the conduit and the interior of the casing. A packer is in communication with the production conduit below the pump and is movable into sealing engagement with the casing to isolate the production zone. A thermal absorber is carried on the production conduit between upper and lower production conduit members whereby subsequent to positioning of the packer assembly into set position, thermal expansion or contraction of the conduit above the set packer is absorbed by the thermal absorber without transmission of thermal expansion or contraction of the conduit to the pump.

6 Claims, 2 Drawing Sheets

WELL PRODUCTION APPARATUS INCLUDING PUMP MEANS AND THERMAL ABSORPTION MEANS

BACKGROUND OF THE INVENTION

1. Field of the Invention

The invention is directed to an apparatus for use in a subterranean well to prevent transmission of thermal expansion and contraction characteristics of a tubular conduit to an electric submersible pump which is anchored in the well by a packer, and to a completion method incorporating same.

2. Brief Description of the Prior Art

In many subterranean wells, natural production zone pressure is insufficient to lift the production fluids from the production zone through the well into the top of the well. Accordingly, artificial lift procedures must be incorporated in such wells. One of the more popular artificial life procedures incorporates the utilization of an electric submersible pump which is actuated by electric current carried to the motor of the pump through a small electric conduit into the well. When such pump is positioned on production conduit, it is normally anchored into the well by means of a packer assembly. Such packer assembly will isolate the production zone below with a zone or portion of the well thereabove. In such instances in which the production conduit is anchored within the well packer, it is possible that thermal expansion or contraction of the conduit, such as by heat due to the increased depth of the well, may be a cause of expansion of the production conduit which will, in turn, have a tendency to place component parts of the electric submersible pump and/or motor into tension or compression, thus wearing out bearings, shafts, and the like, and applying stress characteristics to the pump and reducing its efficiency and life.

The present invention is directed to a method and apparatus which addresses the problems set forth above and incorporates thermal expansion means for remedying this problem.

Additionally, the present invention also includes such thermal expansion means in a completion apparatus and method for production of the well in which a value head below the packer is selectively movable by the conduit in communication with the production conduit.

SUMMARY OF THE INVENTION

The present invention is directed to a well production apparatus. In one embodiment, the production apparatus and its method of use includes a tubular production conduit extending from the top of the well to a production zone and disposed within a casing within the well. An electric submersible pump is carried on the conduit, with the pump having a production fluid flow passageway extending therethrough and communicating between the exterior of the conduit immediate the pump and the interior of the casing. A packer assembly communicates with the production conduit below the pump and is positionable into sealing engagement with the casing to isolate the production zone from a portion of the well thereabove. Thermal absorption means on the production conduit are placed between the upper and lower production conduit members secured thereto. Accordingly, subsequent to positioning the packer assembly into sealing engagement with the casing, thermal expansion or contraction of the conduit above the packer assembly is absorbed by the thermal absorption means without transmission of the thermal expansion or contraction of a conduit to the pump.

In one embodiment, the apparatus also includes a tubular liner having a sealable lower end which is carried by the packer assembly, with a portion of the tubular production conduit being concentrically disposed within the liner. Valve head and seat means are carried on the liner with the valve head being movable between open and closed positions by means on the tubular production conduit to selectively communicate the interior of the production conduit with the production zone. A ported member is also provided on the tubular production conduit above the packer and below the means disposed on the production conduit between the upper and lower production conduit members to direct fluid from within the production conduit from the production zone to the exterior of the production conduit and interior of the casing, and thence to the fluid passageway of the electric submersible pump.

In an alternative embodiment the well production apparatus includes a valve element shifting tool, the shifting tool having an outer housing and means on the housing for interfacing with the packer to prevent upon such interfacing movement of the housing in one direction. First and second tubular members extend through the housing in selective telescopic relationship, one of the tubular members extending to the first production tubing section and the other of the tubular members extending to the second tubular section. Means are carried by one of the members and engaged with the other member to secure the members in a telescopically expanded condition and are movable to permit telescopic contraction of said members. A shoulder on one of the tubular members is provided for securement to the packer to transfer tubing weight of the first production tubing section from one tubular member onto the packer. Means are also defined on the housing for limiting travel of the other of the tubular members in the said one direction and means are provided for urging the tubular members into expanded position whereby securement means are urged into engagement relative to each of the tubular members.

DESCRIPTION OF THE PREFERRED EMBODIMENTS

Figure 1:
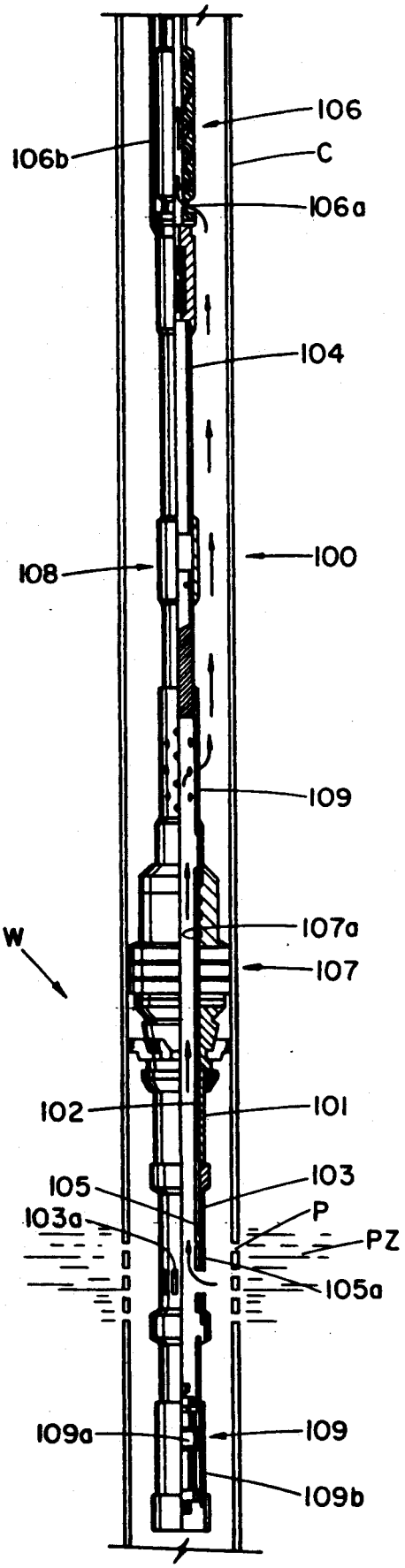
FIG. 1 is a longitudinal sectional view of the apparatus of the present invention shown in position in the well with the packer set above a production zone and production fluid being transmitted through an open valve member through the production conduit thence exteriorly into the annular area between the production conduit and the casing above the set packer and to and through a fluid passageway through the pump for transmission to the top of the well.
Figure 2:
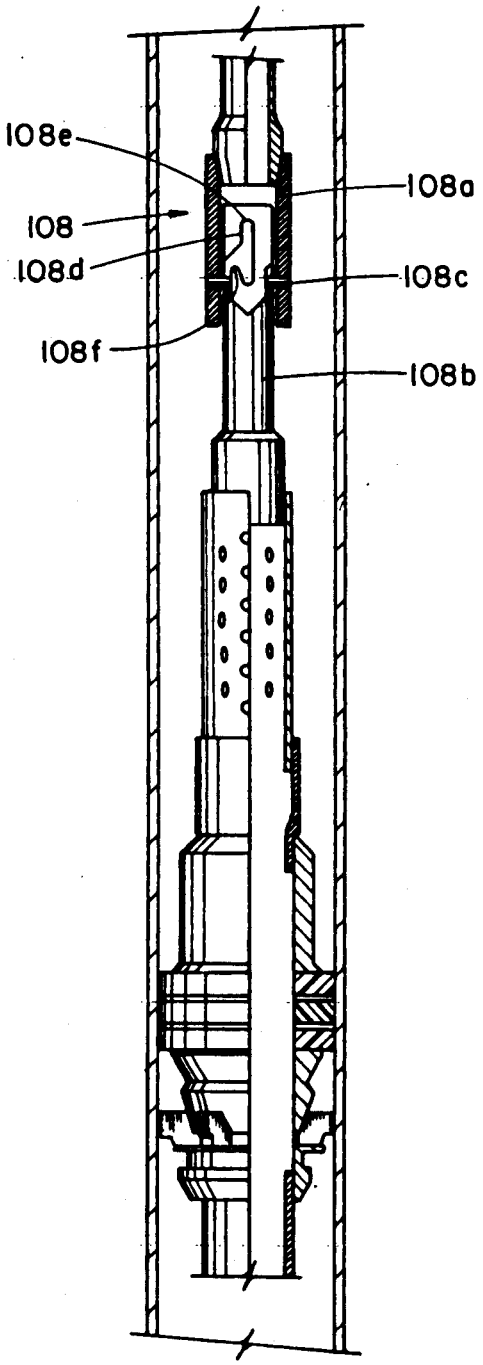
FIG. 2 is a longitudinal sectional illustration detailing a preferred thermal expansion means in combination with a ported member and set packer incorporated into the apparatus.

Now with reference to FIGS. 1 and 2, there is shown a well production apparatus 100 disposed within a well W which previously has been cased with casing conduit C extending from a production zone PZ to the top of the well. Within the production zone PZ, the casing C is perforated with perforations P, in conventional fashion, to permit fluid communication between the production zone PZ and the interior of the casing C.

When performing the well completion method of the present invention, a packer 107 may be run into the well W interior of the casing C with a tubular conduit (or liner) 101 carried at the lowermost end thereof and having a sealed end 109 for sealing receipt of a blanking plug 109*a* within a seating nipple 109*b*.

After running of the packer 107 and the tubular conduit 101, the blanking plug 109*a* may be run into place within the seating nipple 109*b* in conventional fashion, such as by wireline or coiled tubing, to form the sealed end 109.

The tubular conduit 101 has defined thereon a ported member 103 having a series of circumferentially extending ports 103*a* to permit selective communication of fluid from the production zone PZ through the perforations P and into the ports 103*a*, thence through the interior of the tubular conduit 101, as described below. The ported member 103 carries a valve element or valve head 105 interiorly thereof, which may be defined as a sliding sleeve with the ported member 103 also providing a valve seat 105*a* for the element 105. The combination of the valve element 105 and ported member 103 need not be described in particular detail, other than to state that it constitutes a sliding sleeve mechanism with profiles defined within the ported member 103 for receipt of an end of the valve element 105 as it is shifted longitudinally between first and second, or opened and closed, positions relative to the ports 103*a*, by means of a first production tubing section 102 which, in turn, has a companion groove or profile thereon for interfacial receipt of a shifting end of the valve element 105.

The packer means 107 together with the tubular conduit or liner 101, ported member 103, and seating nipple 109*b* may be run into the well and set within the casing C above the production zone PZ in one trip, and independent of the remainder of the components of the well production apparatus 100. In such instance, the packer 107 will be carried into the well W and set by means of a tubular work or production string (not shown) or by conventional wireline or electric line setting means. The packer means 107 is entirely conventional in construction and may be one of a number of components known to those skilled in the art. The packer means 107 may be set electrically, mechanically, hydraulically, or by any other means known to those skilled in the art. The packer 107 may be a permanent-type packer, or may be of a retrievable construction.

If the packer 107 and conduit or liner 101, etc. are run into the well independent of the other components forming the well production apparatus 100, the packer 107 will be set to sealingly engage it against the interior wall of the casing C and it will be anchored to resist longitudinal movement. After the setting procedure, the selected setting mechanism is retrieved from the interior of the well W. Thereafter, the balance of the elements, described below, forming the well production apparatus 100 may be run into the well W on production or workstring and secured through a bore 107*a* in the packer 107.

The entire well production apparatus 100 may be run into the well W in one trip of the production string, but preferably is run in two trips. When it is desired to install the apparatus 100 in several trips of the work or production string, a preferred packer 107 may be the Model "D", production packer, commercially available from the Baker Oil Tools Division, Baker Hughes Production Tools, Inc., Houston, Tex., and as generally shown on page 261 of the 1988–1989 Composite Catalog of Oilfield Equipment and Services, published by World Oil, Houston, Tex.

When the apparatus 100 is installed in the well W by means of one trip of the production tubing, it is run into the well W within the casing C on a second production tubing section 104 which generally extends to the top of the well. An electric submersible pump 106 iS carried on the second production tubing section 104 with and electric conduit 106*b* extending from the pump 106 to the top of the well and secured around the exterior of the second production tubing section 104. A fluid flow passageway 106*a* is provided through the pump 106 and communicates between the interior of the second production tubing section 104 thereabove and the annular area defined by the exterior of the second production tubing section 104 and the interior of the casing C above the sealed packer 107.

The pump 106 is of the electric submersible variety and will include a pump section, electric motor, and gas separator, together with other known auxiliary components, if necessary. The pump 106 incorporated in the present invention preferably will be activated by electric power through the electric conduit 106*b* and may be any one of a number of commercially available pumps. For example, the pump may be that as shown and described on pages 1950–1952 of the Composite Catalog of Oilfield Equipment and Services, 1982–1983, published by World Oil, Houston, Texas, and commercially available from the Centrilift Division of Baker Hughes Incorporated. The operation and construction of such pumps is well-known to those skilled in art and the operation and construction, per se, of such pumps does not form a part of Applicant's invention.

Extending below the pump 106 and carried on the second production tubing section 104 is a thermal absorption means 108 which prevents expansion and contraction of the production tubing from being transmitted directly to the pump 106, thereby eliminating undesirable load being applied to such pump 106 as a result thereof.

Now referring to FIG. 2, the thermal absorption means 108 preferably comprises upper and lower housing members 108*a*, 108*b* which are interengaged for selective telescopic movements by means of a pin 108*c* carried on the outer or upper housing 108*a* and extending within a slot configuration 108*d* profiled on the lower inner housing member 108*b*. The pin 108*c* is positioned in the upper running slot portion 108*e* as the apparatus 100 is run into the well. In such position, the upper housing 108*a* and lower housing 108*b* are telescopically expanded relative to one another.

Subsequent to the setting of the packer 107 and shifting of the valve element 105 (if necessary), the second production tubing section 104 is manipulated to longitudinally shift the pin 108*c* relative to the slot 108*d* to move the pin 108*c* from the upper running slot 108*e* to the expansion slot 108*f*. During such activation, the production tubing section 104 will be rotated, slightly.

ALTERNATIVE VALVE ELEMENT SHIFTING TOOL

Figure 3:
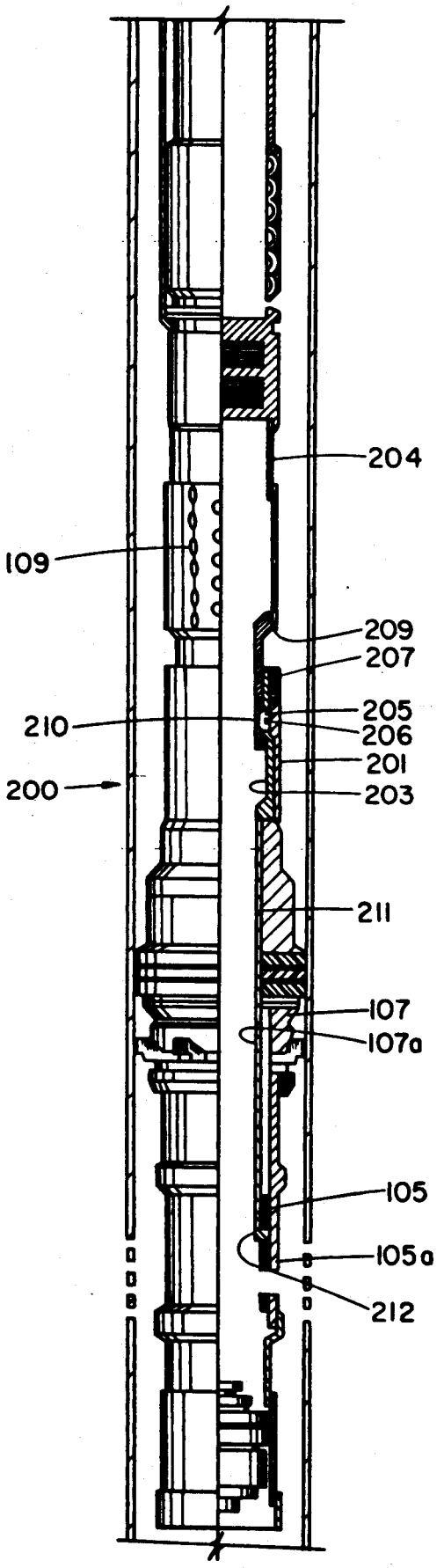
FIG. 3 is a longitudinal view of an alternative embodiment of the present invention in run-in position.
Figure 4:
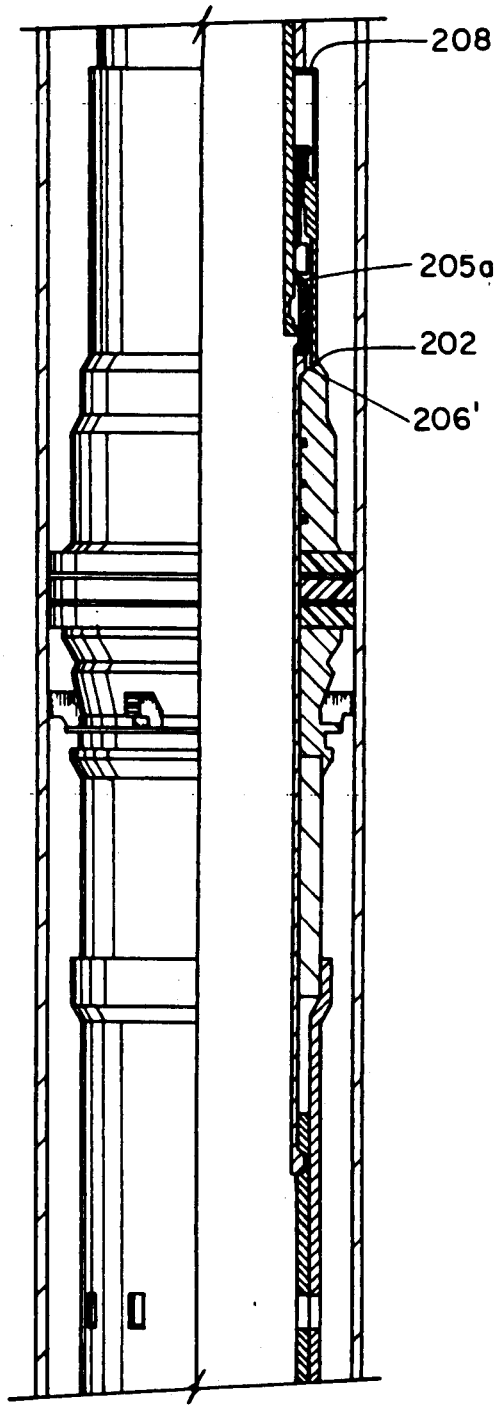
FIG. 4 is a view similar to that of FIG. 3 showing the alternative embodiment in set position.

Now referring to FIGS. 3 and 4, there is shown an alternative embodiment defining a valve element shifting tool 200. The tool 200 has an elongated outer housing 201 with a first tubular member 203 housed therein and extending to a seal assembly 211 for companion receipt within the bore 107a of the packer 107 when the valve element shifting tool 200 is incorporated into the apparatus 100 and run into the packer 107.

The first tubular member 203 has extending downwardly of the seal assembly 211 a valve element, or sleeve shifting member 212 for movement of the valve element 105 relative to the valve seat 105a. In the alternative valve element shifting tool 200, the valve element 212 serves the same function as the first production tubing section 102 relatively to the valve element 105, with a groove or shoulder profiled exteriorly around the element 212 for actuating contact with the valve element 105 for shifting purposes.

The valve element shifting tool 200 also has an outer cylindrical housing 201 having a top shoulder member 208 at its uppermost end for companion interface with an outwardly protruding abuttment 209 carried on the lower housing 108b when the tool 200 is in telescopically retracted position.

A second tubular member 204 is carried through the top end or shoulder 208 of the tool 200 and is initially interengaged with the first tubular member 203 by means of a series of lugs 205 carried within a bore 205a of the first tubular member 203 with the inner diameter of the lugs extending within a profiled groove 210 exteriorly defined around the second tubular member 204. The lugs 205 are inwardly urged by means of a garter spring 206 carried in the medial portion of the lugs 205 such that tubing weight is carried through the valve element 212 and seal assembly 211 and the first tubular member 203 through the lugs 205 into the second tubular member 204, to the top of the well.

A spring 207 is housed interior of the outer housing 201 and exterior of the first tubular member 203 to urge the first tubular member 203 upwardly relative to the outer housing 201.

When the valve element shifting tool 212 is positioned within the packer bore 107a, downward movement of the seal assembly 211 and the valve element 212 will be prevented upon interface of the shoulder 206 with a companion shoulder 206' around the uppermost end of the packer 107. Correspondingly, the lowermost end 202 of the first tubular member 203 is also received on the shoulder 206' of the packer 107.

OPERATION

Now with reference to FIGS. 1 and 2, when the embodiment shown therein is utilized, it may, as stated previously, be run either in one or more trips of tubing into the well. Preferably, the apparatus 100 will be run into the well W in two or more trips.

The components of the apparatus 100 are assembled at the top of the well as above described and as shown in the Figs. Thereafter, the apparatus 100 is run into the well and the packer 107 set. If the valve element 105 has not been previously manipulated to the open position, or left in the open position during the preceding completion operations of the well, it may be manipulated to the open position by shifting of the first production tubing section 102 and second production tubing section 104 subsequent to the setting of the packer 107.

After the packer 107 has been set within the casing C above the production zone PZ and the valve element 105 is in position to communicate the ports 103 with the interior of the tubular conduit 101 and the first production tubing section 102, the production sections 102, 104 are picked up at the top of the well W and rotated to move the pin 108c within the J-slot 108d from the initial or running in position 108e to the telescopic contraction position 108f, as shown in FIG. 2. In such position, the upper housing member 108a has been telescopically contracted with respect to the lower housing member 108b. In such telescopically contracted position, the thermal absorption means 108 now will prevent expansion and contraction characteristics in the second production tubing section 104 from being transmitted directly to the pump means 106 such that the members of the pump 106 are never placed in additional compression or tension as a result of thermal increase or decrease of the tubular section within the well W. Now, the pump 106 may be actuated by directing electrical power through the conduit 106b such that fluids within the production zone PZ may be pumped through the ports 103a and into the production tubing section 102, thence above the set packer 107 through the ported sub 109 into the annular area between the second production tubing section 104 and casing C, thence through the passageway 106a in the pump 106, and to the top of the well through the interior of the section production tubing section 104.

Now referring to FIGS. 3 and 4, when the alternate valve element shifting tool 200 is substituted for the telescopic expansion element shown in FIGS. 1 and 2 as the thermal absorption means 108, the ported sub 109 will be positioned on the second production tubing section 104 above the tool 200.

When the apparatus 100 incorporates the valve element shifting tool 200, the packet 107 must be run into the well and set together with the tubular conduit or liner 101 and valve element 105, with the end 109 either being sealed by means of the blanking plug 109a, or the blanking plug 109a being subsequently placed in position, as shown.

After the packer 107 is set, the ported sub 109, pump 106, valve element shifting tool 200 and second production tubing section 104 and section 102 are run into the well until such time as the end 202 of the outer housing 201 interfaces with the profile 206' on the packer bore 107a. As this action occurs, the valve element shifting tool 200 may continue to be stroked downwardly, permitting the valve element 212 to move to open the ports 103a. Additionally, such stroking of the lower housing 108b, second tubular member 204 and valve element 212 will move the lugs 205 away from an inwardly extending portion 201' of the outer housing 201.

Subsequent to the stroke required to manipulate the valve element 212 to open the ports 103a, the shoulder 206' on the seal assembly 211 will interface with the bore 107a of the packer 107 thereby preventing further longitudinal movement of the lower housing 108b, tubular member 204 and seal assembly 211. As continued downward weight is applied on the lower housing 108b, the lugs 205 will be pushed outwardly to overcome the inward force defined through the garter spring 206 and second tubular member 204 will become disengaged relative to the lugs 205, permitting further continued downward movement. This further downward movement is the defined contraction of the second tubular member 204 relative to the first tubular member 203 and provides for thermal expansion to be absorbed by the tool 200 as opposed to transfer and adverse impact upon the components of the pump 106.

The maximum contraction of the tubular member 204 relative to the member 20o is defined by the interface of the abuttment 209 on the lower housing **108*b* interfacing the top shoulder 208. When the interface 208, 209 is effected, further downward movement of the members 204 and 203 relative to one another is prevented. However, in construction, normal thermal characteristics in the well will be taken into consideration in calculating such contraction relative length between the members 204 and 203**.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. A well production apparatus, comprising:

(1) a tubular production conduit extending from the top of the well to a production zone and disposed within casing in said well;

(2) an electric submersible pump on said conduit, said pump having a production fluid flow passageway extending therethrough and communication between the exterior of said conduit immediate said pump and the interior of said casing;

(3) a packer assembly in communication with said production conduit below said pump and positionable into sealing engagement with said casing to isolate said production zone from a portion of the well thereabove; and (4) thermal absorption means on said production conduit between upper and lower production conduit members secured thereto whereby, subsequent to positioning of said packer assembly into sealing engagement with said casing, thermal expansion or contraction of said conduit above said packer assembly is absorbed by said thermal absorption means without transmission of said thermal expansion or contraction of said conduit to said pump the thermal absorption means comprising first and second housing members, said first housing member being secured to said upper production conduit member and said second housing member being secured to said lower production conduit member, one of said housing members defining a slot therethrough for receipt of lug means carried on the other housing member, said lug means and said slot when in a first position relative to one another preventing axial rotation between said upper and lower production conduit members and being movable by manipulation of said tubular production conduit to another position whereby said upper and lower production conduit members are movable longitudinally in telescopic relationship.

2. A well production apparatus, comprising:

(1) a tubular production conduit extending from the top of the well to a production zone and disposed within casing in said well;

(2) an electric submersible pump on said conduit said pump having a production fluid flow passageway extending therethrough and communicating between the exterior of said conduit immediate said pump and the interior of said casing;

(3) a packer assembly in communication with said production conduit below said pump and positionable into sealing engagement with said casing to isolate said production zone from a portion of said well thereabove; and (4) means disposed on said production conduit between upper and lower production conduit members secured thereto to permit selective telescopic movement between said production conduit members subsequent to positioning of said packer assembly into sealing engagement with said casing, whereby subsequent to such positioning, thermal expansion or contraction of said conduit above said packer assembly is absorbed through movement between said production conduit members, without transmission of said thermal expansion or contraction of said conduit to said pump, the thermal absorption means comprising first and second housing members, said first housing member being secured to said upper production conduit member and said second housing member being secured to said lower production conduit member, one of said housing members defining a slot therethrough for receipt of lug means carried on the other housing member, said lug means and said slot when in a first position relative to one another preventing axial rotation between said upper and lower production conduit members and being movable by manipulation of said tubular production conduit to another position whereby said upper and lower production conduit members are movable longitudinally in telescopic relationship.

3. A well production apparatus, comprising:

(a) a tubular conduit;

(b) a first production tubing section interiorly disposed relative to at least a portion of said tubular conduit;

(c) a ported member carried by said tubular conduit for communicating fluids between the interior and the exterior of said first production tubing section;

(d) a second production tubing section extending to the top of the well;

(e) a valve element carried by said tubular conduit and movable between first and second positions to selectively open and closed said ported member;

(f) an electric submersible pump positioned on said second production tubing section;

(g) a packer settable in said well above a production zone and below said pump and carrying at its lowermost end the tubular conduit;

(h) a valve element shifting tool, comprising;

(1) an outer housing;

(2) means on said housing for interfacing with said packer to prevent, upon such interfacing, movement of said housing in one direction;

(3) first and second tubular members extending through said housing in selective telescopic relationship, one of said tubular members extending to the first production tubing section and the other of said tubular members extending to the second tubular section;

(4) means carried by one of said members and engagable with the other member to secure said members in a telescopically expanded condition, and movable to permit telescopic contraction of said members;

(5) a shoulder on one of said tubular members for securement to said packer to transfer tubing weight of said first production tubing section from said one tubular member onto said packer;

(6) means on said housing for limiting travel of the other of said tubular members in said one direction; and (7) means for urging said tubular members into expanded position whereby said securement means are urged into engagement relative to each of said tubular members, The means carried by one of said members and engagable with the other member comprising radially expanded selectively contractable ring means.

4. The apparatus of claim 3 wherein the means carried by one of said members and engagable with the other member comprises radially expanded ring means biased to a contracted position.

5. The apparatus of claim 3 wherein the means carried by one of said members and engagable with the other member comprises radially expanded ring means biased to a contracted position and received within a groove on one of said members when said members are in telescopically expanded position.

6. The apparatus of claim 3 wherein the means carried by one of said members and engagable with the other member comprises radially expanded ring means biased to a contracted position and received within a groove on one of said members when said members are in telescopically expanded position and removable therefrom when said telescopic members are in contracted position.

* * * * *